US011774136B2

(12) United States Patent
Hatcher et al.

(10) Patent No.: US 11,774,136 B2
(45) Date of Patent: Oct. 3, 2023

(54) AIR CONDITIONER DRAIN PAN PLATFORM

(71) Applicant: Haier US Appliance Solutions, Inc., Wilmington, DE (US)

(72) Inventors: Stephen D. Hatcher, Henryville, IN (US); Logan Chayse Dunaway, Greenville, IN (US); Richard Michael Phillips, Louisville, KY (US); Christopher Raymond Geisen, Louisville, KY (US); Robert T. Mills, Louisville, KY (US); Cody Ewing, Floyds Knobs, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 261 days.

(21) Appl. No.: 17/093,434

(22) Filed: Nov. 9, 2020

(65) Prior Publication Data

US 2022/0146145 A1 May 12, 2022

(51) Int. Cl.

| | |
|---|---|
| ***F24F 13/22*** | (2006.01) |
| ***F24F 13/32*** | (2006.01) |
| ***F24F 13/30*** | (2006.01) |
| ***F24F 13/20*** | (2006.01) |

(52) U.S. Cl.

CPC ..... *F24F 13/222* (2013.01); *F24F 13/20* (2013.01); *F24F 13/30* (2013.01); *F24F 13/32* (2013.01)

(58) Field of Classification Search

CPC ..... F24F 13/222; F24F 13/20; F24F 13/30; F24F 13/32; F24F 13/22

See application file for complete search history.

(56) References Cited

U.S. PATENT DOCUMENTS

| | | | | |
|---|---|---|---|---|
| 2,560,467 | A * | 7/1951 | Moore | F24F 1/04 62/297 |
| 6,901,766 | B1 * | 6/2005 | Jin | F24F 13/222 62/286 |
| 7,673,646 | B1 * | 3/2010 | Cantolino | F24F 13/222 137/15.01 |
| 9,247,816 | B2 * | 2/2016 | Sorrell | A47B 9/20 |

(Continued)

FOREIGN PATENT DOCUMENTS

| | | |
|---|---|---|
| CN | 101173780 A | 5/2008 |
| CN | 202328713 U | 7/2012 |

(Continued)

OTHER PUBLICATIONS

NPL-1 (Component Hardware) (Year: 2019).*

(Continued)

*Primary Examiner* — David J Teitelbaum
*Assistant Examiner* — Devon Moore
(74) *Attorney, Agent, or Firm* — Dority & Manning, P.A.

(57) ABSTRACT

An air conditioning appliance includes a housing, a drain pan positioned below the housing, and a plenum which is attached to the housing and to the drain pan. The drain pan includes an upper surface in contact with the housing and a socket configured to receive a leg. The housing of the air conditioning appliance rests on the upper surface of the drain pan, such that the drain pan defines a platform which structurally supports the housing of the air conditioning appliance.

18 Claims, 14 Drawing Sheets

(56) References Cited

U.S. PATENT DOCUMENTS

| | | | | |
|---|---|---|---|---|
| 2006/0144071 | A1* | 7/2006 | Rowland | B65D 1/40<br>62/285 |
| 2018/0106507 | A1* | 4/2018 | Eicher | F24F 1/027 |
| 2021/0063028 | A1* | 3/2021 | Phillips | F24F 1/027 |
| 2021/0148602 | A1* | 5/2021 | Michel | F24F 13/32 |

FOREIGN PATENT DOCUMENTS

| | | | | |
|---|---|---|---|---|
| CN | 109028534 | A | * | 12/2018 |
| JP | 2011237058 | A | | 11/2011 |

OTHER PUBLICATIONS

NPL-2 (Post Bases Standard Finish: Electro Galvanized) (Year: 2018).*
CN-109028534-A English Translation (Year: 2018).*

* cited by examiner

AIR CONDITIONER DRAIN PAN PLATFORM

FIELD OF THE INVENTION

The present subject matter relates generally to air conditioning appliances, and more particularly to platforms for air conditioning appliances.

BACKGROUND OF THE INVENTION

Air conditioner or air conditioning appliance units are conventionally utilized to adjust the temperature within structures such as dwellings and office buildings. In particular, one-unit type room air conditioner units, such as single-package vertical units (SPVU), or package terminal air conditioners (PTAC) may be utilized to adjust the temperature in, for example, a single room or group of rooms of a structure. A typical one-unit type air conditioner or air conditioning appliance includes an indoor portion and an outdoor portion. The indoor portion generally communicates (e.g., exchanges air) with the area within a building, and the outdoor portion generally communicates (e.g., exchanges air) with the area outside a building. Accordingly, the air conditioner unit generally extends through, for example, an outer wall of the structure. Generally, a fan may be operable to rotate to motivate air through the indoor portion. Another fan may be operable to rotate to motivate air through the outdoor portion. A sealed cooling system including a compressor is generally housed within the air conditioner unit to treat (e.g., cool or heat) air as it is circulated through, for example, the indoor portion of the air conditioner unit. One or more control boards are typically provided to direct the operation of various elements of the particular air conditioner unit.

Some conventional air conditioning appliances include a plenum for directing air to or from an outdoor portion of the air conditioning appliance. When installed, the plenum may be positioned through a wall of the building or structure. The wall may be an outer wall such that the plenum extends from an interior portion of the building to an exterior portion of the building. Thus, a portion of the plenum will often extend to and be visible from an area outside of the building. However, it is generally preferable (e.g., for aesthetics, support, sizing, performance, etc.) to minimize the amount of plenum exposed to the exterior environment.

The lack of standard wall positions (e.g., height relative to the floor) for plenums across various installations makes connecting and supporting the remainder of the air conditioner unit difficult. For example, the remainder of the air conditioner unit must be aligned with the plenum in a specific way. In some instances, the plenum may be positioned at a height in the wall such that the bottom of the air conditioner unit, such as a drain pan of the air conditioner unit, may rest directly on the floor. However, in other instances, the plenum may be positioned in the wall such that when the remainder of the air conditioner unit is properly aligned with the plenum, the remainder of the air conditioner unit is above the floor and is thus unsupported.

Typically, a platform may be constructed to support the remainder of the air conditioner unit when the plenum is located in the wall such that the remainder of the air conditioner unit is positioned above the floor. Because the installation height of the plenum through the wall varies from case to case, and even from room to room in some installations, the platform must be bespoke for each air conditioner unit. Additionally, such platforms are often constructed out of whatever scrap material may be presently at hand at the time of installation. Moreover, bespoke construction of the platform can be difficult and time-consuming in order to reach the correct height to position the remainder of the air conditioner unit above the floor and in the proper alignment with the plenum, e.g., the air conditioner unit may have to be installed, placed on a temporary support, and then measured to determine the needed height of the platform, before taking the remainder of the air conditioner unit (i.e., other than the plenum which is mounted in the wall) down in order to build the platform. Further, inasmuch as the platform is bespoke to each unit, this entire process must be repeated for each and every unit, which can add significant time to a multi-unit project such as a hotel or apartment building.

As a result, further improvements to air conditioners may be advantageous. In particular, it would be useful to provide a standardized platform with features for improved ease of installation which can be adjusted as needed for various installation conditions.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, an air conditioner unit is provided. The air conditioner unit defines a mutually-perpendicular vertical direction, lateral direction, and transverse direction. The air conditioner unit includes a housing that defines an outdoor portion and an indoor portion. An outdoor heat exchanger assembly is disposed in the outdoor portion. The outdoor heat exchanger assembly includes an outdoor heat exchanger and an outdoor fan. An indoor heat exchanger assembly is disposed in the indoor portion. The indoor heat exchanger assembly includes an indoor heat exchanger and an indoor fan. A compressor is in fluid communication with the outdoor heat exchanger and the indoor heat exchanger to circulate a refrigerant between the outdoor heat exchanger and the indoor heat exchanger. A drain pan is positioned below the housing along the vertical direction. The drain pan includes an upper surface in contact with the housing of the air conditioner unit and a socket configured to receive a leg. A plenum is attached to the housing and to the drain pan. The plenum is receivable within a wall channel defined by a structure wall along an axial direction. The housing of the air conditioner unit rests on the upper surface of the drain pan, such that the drain pan defines a platform which structurally supports the housing of the air conditioner unit.

In another exemplary aspect of the present disclosure, an air conditioning appliance is provided. The air conditioning appliance includes a housing that defines an outdoor portion and an indoor portion. An outdoor heat exchanger assembly is disposed in the outdoor portion. The outdoor heat exchanger assembly includes an outdoor heat exchanger and an outdoor fan. An indoor heat exchanger assembly is disposed in the indoor portion. The indoor heat exchanger assembly includes an indoor heat exchanger and an indoor fan. A compressor is in fluid communication with the outdoor heat exchanger and the indoor heat exchanger to circulate a refrigerant between the outdoor heat exchanger and the indoor heat exchanger. A drain pan is positioned below the housing. The drain pan includes an upper surface in contact with the housing of the air conditioner unit and a socket configured to receive a leg. A plenum is attached to the housing and to the drain pan. The plenum is receivable within a wall channel defined by a structure wall along an axial direction. The housing of the air conditioner unit rests on the upper surface of the drain pan, such that the drain pan defines a platform which structurally supports the housing of the air conditioner unit.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
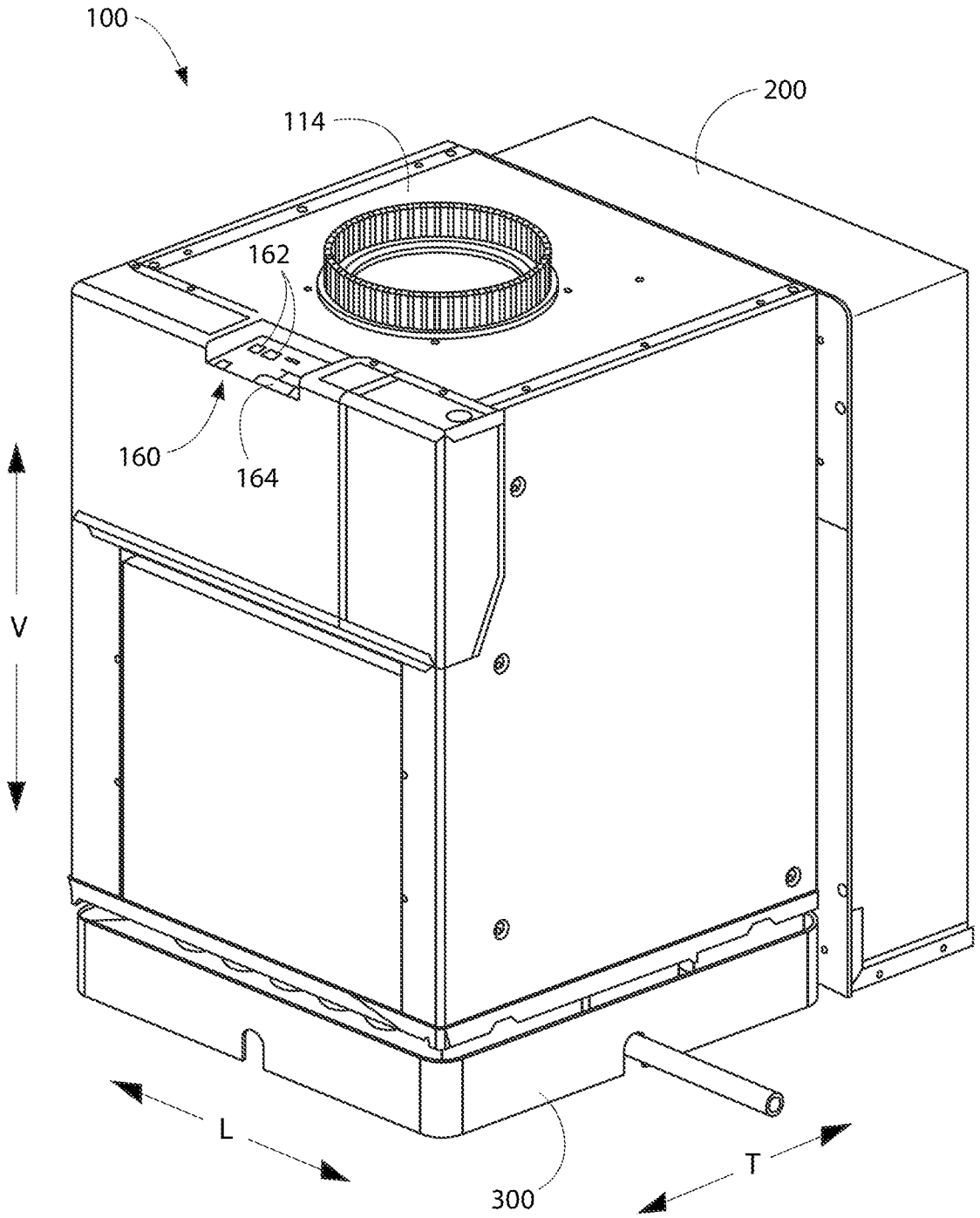
FIG. 1 provides a perspective view of an air conditioning appliance according to one or more exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "includes" and "including" are intended to be inclusive in a manner similar to the term "comprising." Similarly, the term "or" is generally intended to be inclusive (i.e., "A or B" is intended to mean "A or B or both"). The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

As used herein, terms of approximation, such as "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

Figure 2:
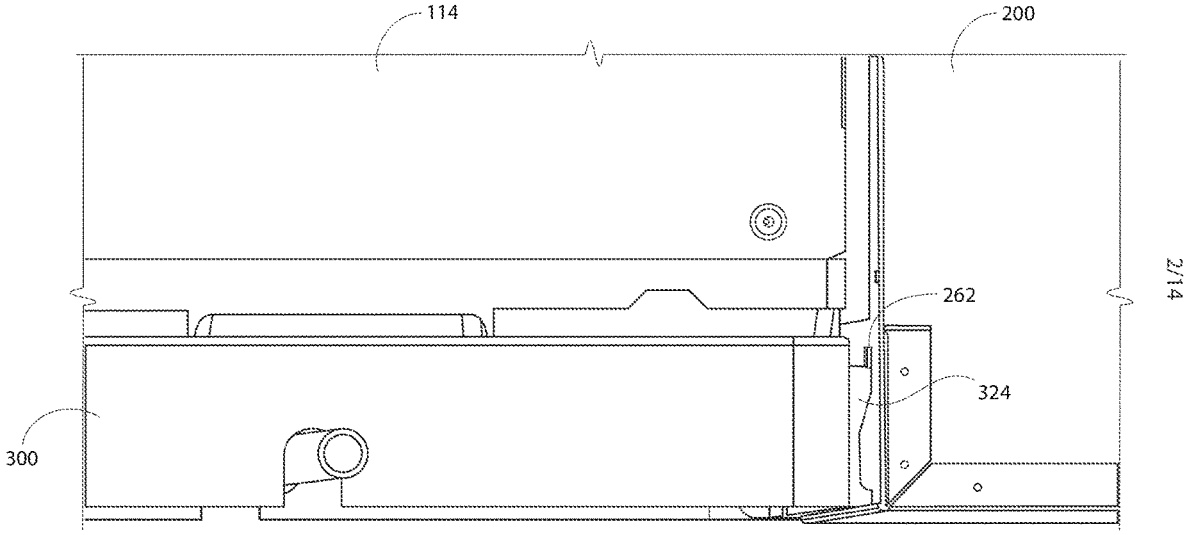
FIG. 2 provides an enlarged view of a portion of the exemplary air conditioner unit of FIG. 1 according to one or more exemplary embodiments of the present disclosure.
Figure 3:
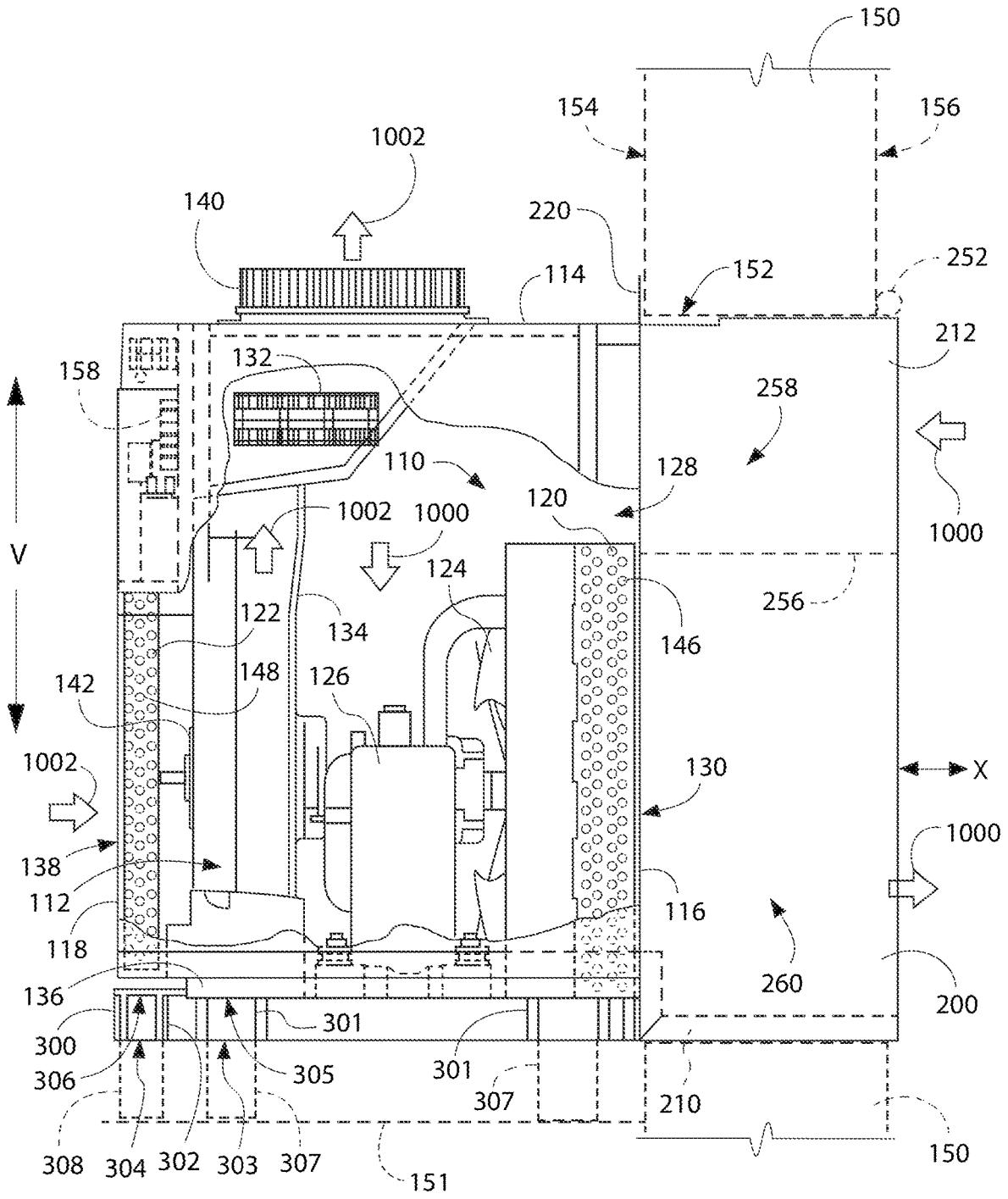
FIG. 3 provides a section view of the air conditioning appliance of FIG. 1 according to one or more exemplary embodiments of the present disclosure.

Turning now to the figures, FIGS. 1 through 3 illustrate an exemplary air conditioner appliance (e.g., air conditioner 100). As shown, air conditioner 100 may be provided as a one-unit type air conditioner 100, such as a single-package vertical unit. Air conditioner 100 includes a package housing 114 supporting an indoor portion 112 and an outdoor portion 110.

Generally, air conditioner 100 defines a vertical direction V, lateral direction L, and transverse direction T. Each direction V, L, T is perpendicular to each other, such that an orthogonal coordinate system is generally defined.

In some embodiments, housing 114 contains various other components of the air conditioner 100. Housing 114 may include, for example, a rear opening 116 (e.g., with or without a grill or grate thereacross) and a front opening 118 (e.g., with or without a grill or grate thereacross) which may be spaced apart from each other along the transverse direction T. The rear opening 116 may be part of the outdoor portion 110, while the front opening 118 is part of the indoor portion 112. Components of the outdoor portion 110, such as an outdoor heat exchanger 120, outdoor fan 124, and compressor 126 may be enclosed within housing 114 between front opening 118 and rear opening 116. In certain embodiments, one or more components of outdoor portion 110 are mounted on a base 136, as shown. The base 136 may be received on or within a drain pan 300.

During certain operations, air 1000 may be drawn to outdoor portion 110 through rear opening 116. Specifically, an outdoor inlet 128 defined through housing 114 may receive outdoor air 1000 motivated by outdoor fan 124. Within housing 114, the received outdoor air 1000 may be motivated through or across outdoor fan 124. Moreover, at least a portion of the outdoor air 1000 may be motivated through or across outdoor heat exchanger 120 before exiting the rear opening 116 at an outdoor outlet 130. It is noted that although outdoor inlet 128 is illustrated as being defined above outdoor outlet 130, alternative embodiments may reverse this relative orientation (e.g., such that outdoor inlet 128 is defined below outdoor outlet 130) or provide outdoor inlet 128 beside outdoor outlet 130 in a side-by-side orientation, or another suitable orientation.

As shown, indoor portion 112 may include an indoor heat exchanger 122, a blower fan 142, and a heating unit 132. These components may, for example, be housed behind the front opening 118. A bulkhead 134 may generally support or house various other components or portions thereof of the indoor portion 112, such as the blower fan 142. Bulkhead 134 may generally separate and define the indoor portion 112 and outdoor portion 110 within housing 114. Additionally or alternatively, bulkhead 134 or indoor heat exchanger 122 may be mounted on base 136 (e.g., at a higher vertical position than outdoor heat exchanger 120), as shown.

During certain operations, air 1002 may be drawn to indoor portion 112 through front opening 118. Specifically, an indoor inlet 138 defined through housing 114 may receive indoor air 1002 motivated by blower fan 142. At least a portion of the indoor air 1002 may be motivated through or across indoor heat exchanger 122 (e.g., before passing to bulkhead 134). From blower fan 142, indoor air 1002 may be motivated (e.g., across heating unit 132) and returned to the indoor area of the room through an indoor outlet 140 defined through housing 114 (e.g., above indoor inlet 138 along the vertical direction V). Optionally, one or more conduits (not pictured) may be mounted on or downstream from indoor outlet 140 to further guide air 1002 from air conditioner 100. It is noted that although indoor outlet 140 is illustrated as generally directing air upward, it is understood that indoor outlet 140 may be defined in alternative embodiments to direct air in any other suitable direction.

Outdoor and indoor heat exchanger 120, 122 may be components of a thermodynamic assembly (i.e., sealed system), which may be operated as a refrigeration assembly (and thus perform a refrigeration cycle) or, in the case of the heat pump unit embodiment, a heat pump (and thus perform a heat pump cycle). Thus, as is understood, exemplary heat pump unit embodiments may be selectively operated to perform a refrigeration cycle at certain instances (e.g., while in a cooling mode) and a heat pump cycle at other instances (e.g., while in a heating mode). By contrast, exemplary A/C exclusive unit embodiments may be unable to perform a heat pump cycle (e.g., while in the heating mode), but still perform a refrigeration cycle (e.g., while in a cooling mode).

The sealed system may, for example, further include compressor 126 (e.g., mounted on base 136) and an expansion device (e.g., expansion valve or capillary tube—not pictured), both of which may be in fluid communication with the heat exchangers 120, 122 to flow refrigerant therethrough, as is generally understood. The outdoor and indoor heat exchanger 120, 122 may each include coils 146, 148, as illustrated, through which a refrigerant may flow for heat exchange purposes, as is generally understood.

A plenum 200 may be provided to direct air to or from housing 114. When installed, plenum 200 may be selectively attached to (e.g., fixed to or mounted against) housing 114 (e.g., via a suitable mechanical fastener, adhesive, gasket, etc.) and extend through a structure wall 150 (e.g., an outer wall of the structure within which air conditioner 100 is installed) and above a floor 151. In particular, plenum 200 extends along an axial direction X (e.g., parallel to the transverse direction T) through a hole or channel 152 in the structure wall 150 that passes from an internal surface 154 to an external surface 156. Optionally, a caulk bead 252 (i.e., adhesive or sealant caulk) may be provided to join the plenum 200 to the external surface 156 of structure wall 150 (e.g., about or outside from wall channel 152).

The plenum 200 includes a duct wall 212 that is formed about the axial direction X (e.g., when mounted through wall channel 152). Duct wall 212 may be formed according to any suitable hollow shape, such as conduit having a rectangular profile (shown), defining an air channel 210 to guide air therethrough. Moreover, duct wall 212 may be formed from any suitable non-permeable material (e.g., steel, aluminum, or a suitable polymer) for directing or guiding air therethrough. In certain embodiments, plenum 200 further includes an outer flange 220 that extends in a radial direction (e.g., perpendicular to the axial direction X) from duct wall 212. Specifically, outer flange 220 may extend radially outward (e.g., away from at least a portion of the axial direction X or the duct wall 212).

In some embodiments, plenum 200 includes a divider wall 256 within air channel 210. When assembled, divider wall 256 defines a separate upper passage 258 and lower passage 260. For instance, divider wall 256 may extend along the lateral direction L from one lateral side of plenum 200 to the other lateral side. Generally, upper passage 258 and lower passage 260 may divide or define two discrete air flow paths for air channel 210. When assembled, upper passage 258 and lower passage 260 may be fluidly isolated by divider wall 256 (e.g., such that air is prevented from passing directly between passages 258 and 260 through divider wall 256, or another portion of plenum 200). Upper passage 258 may be positioned upstream from outdoor inlet 128. Lower passage 260 may be positioned downstream from outdoor outlet 130

The operation of air conditioner 100 including compressor 126 (and thus the sealed system generally), blower fan 142, outdoor fan 124, heating unit 132, and other suitable components may be controlled by a control board or controller 158. Controller 158 may be in communication (via for example a suitable wired or wireless connection) to such components of the air conditioner 100. By way of example, the controller 158 may include a memory and one or more processing devices such as microprocessors, CPUs or the like, such as general or special purpose microprocessors operable to execute programming instructions or micro-control code associated with operation of air conditioner 100. The memory may be a separate component from the processor or may be included onboard within the processor. The memory may represent random access memory such as DRAM, or read only memory such as ROM or FLASH.

Air conditioner 100 may additionally include a control panel 160 and one or more user inputs 162, which may be included in control panel 160. The user inputs 162 may be in communication with the controller 158. A user of the air conditioner 100 may interact with the user inputs 162 to operate the air conditioner 100, and user commands may be transmitted between the user inputs 162 and controller 158 to facilitate operation of the air conditioner 100 based on such user commands. A display 164 may additionally be provided in the control panel 160, and may be in communication with the controller 158. Display 164 may, for example be a touchscreen or other text-readable display screen, or alternatively may simply be a light that can be activated and deactivated as required to provide an indication of, for example, an event or setting for the air conditioner 100.

Turning now specifically to FIG. 2, an enlarged view of a portion of FIG. 1 is provided in order to illustrate attachment of the drain pan 300 to the plenum 200 according to at least one example embodiment. As shown in FIG. 2, the drain pan 300 may include a hook 310 and the plenum 200 may include a slot 262. The hook 310 and the slot 262 may be configured to engage and thereby attach the drain pan 300 to the plenum 200. With the drain pan 300 so attached to the plenum 200, the drain pan 300 is supported on one side or one end thereof by the plenum 200, e.g., when the plenum 200 is installed within and through the wall 150, as illustrated in FIG. 3.

Also as may be seen in FIG. 3, in some instances when the plenum 200 is installed within the wall 150 above the floor 151, the remainder of the air conditioner unit 100 may be suspended or cantilevered from the plenum 200, e.g., supported by the hook 310. In order to avoid this and thereby minimize or avoid damage to the hook 310, one or more support legs 307 and/or 308 may be provided between the drain pan 300 and the floor 151. Where the installation height of the plenum 200 above the floor 151 varies, the required height of the leg(s) 307 and/or 308 will also vary. Thus, the leg(s) 307 and/or 308 may be cut in the field and custom-fitted to the specific installation.

The drain pan 300 may include one or more sockets which are configured to receive the leg(s) 307 and/or 308. For example, as illustrated in FIG. 3, the drain pan 300 may include a first socket 301 and a second socket 302. As will be appreciated from FIGS. 2 and 3, the socket(s) 301 and/or 302 are positioned opposite the hook 310 along the transverse direction T. For example, the hook 310 may be positioned at a first transverse end of the drain pan 300 and the socket(s) 301/302 may be positioned opposite the hook 310 at or near a second transverse end of the drain pan 300. Also as may be seen in FIG. 3, in some embodiments the drain pan 300 may also or instead include one or more of the sockets 301 and/or 302 at the other end of the pan 300, e.g., proximate the plenum 200.

In various embodiments, one or both of the sockets 301 and 302 may be provided. In some embodiments, each socket 301 and 302 may be one of a pair of matching shaped sockets which are spaced apart along the lateral direction L and aligned along the transverse direction T. Thus, possible combinations include, for example, one pair of first sockets 301, one pair of second sockets 302, or two pairs of sockets, e.g., a pair of first sockets 301 and a pair of second sockets 302, or two pairs of sockets with the pairs spaced apart from each other along the transverse direction T. Additional embodiments may also include one or more pairs of matching shaped sockets which are spaced apart along the lateral direction L and aligned along the transverse direction T with respect to each other and which are spaced apart along the transverse direction T with respect to the other pair(s) of sockets 301 and/or 302.

As illustrated in FIG. 3, the first socket 301 is defined between an open end 303 and a top surface 305. The open end 303 and the top surface 305 are spaced apart along the vertical direction V such that the first socket 301 extends along the vertical direction V from the open end 303 to the top surface 305. Similarly, the second socket 302 is defined between an open end 304 and a top surface 306. The open end 304 and the top surface 306 are spaced apart along the vertical direction V such that the second socket 302 extends along the vertical direction V from the open end 304 to the top surface 306. When a leg or legs 307, 308 is/are received in the corresponding socket(s) 301, 302, the top of the leg 307 or 308 will abut one of the top surfaces 305 or 306, or the top of each leg 307, 308 will abut a respective top surface 305, 306.

The material for the leg(s) 307/308 may be any suitable material which is strong enough to bear the weight of the housing 114 and drain pan 300. For example, materials which are likely to be readily available during installation of the air conditioner unit and which can be suitable for forming the leg(s) 307/308 include building materials such as lumber, e.g., dimensional lumber such as a nominal two-inch-by-four-inch board, commonly referred to as a two-by-four, or plumbing, e.g., PVC piping having sufficient size (e.g., outer diameter, wall thickness, etc.). Thus, in some embodiments, the socket, e.g., first socket 301, may have a rectangular cross-section and may thereby be configured to receive a leg 307 made of lumber, such as a two-by-four leg, a two-by-six leg, or a four-by-four leg, etc. Additionally, in some embodiments, the socket, e.g., the second socket 302, may be cylindrical and may thereby be configured to receive a round, e.g., cylindrical, leg 308, such as a piece of piping, e.g., a PVC pipe as mentioned above, or, as another example, a steel pipe or other tubular or solid round leg 308.

Figure 4:
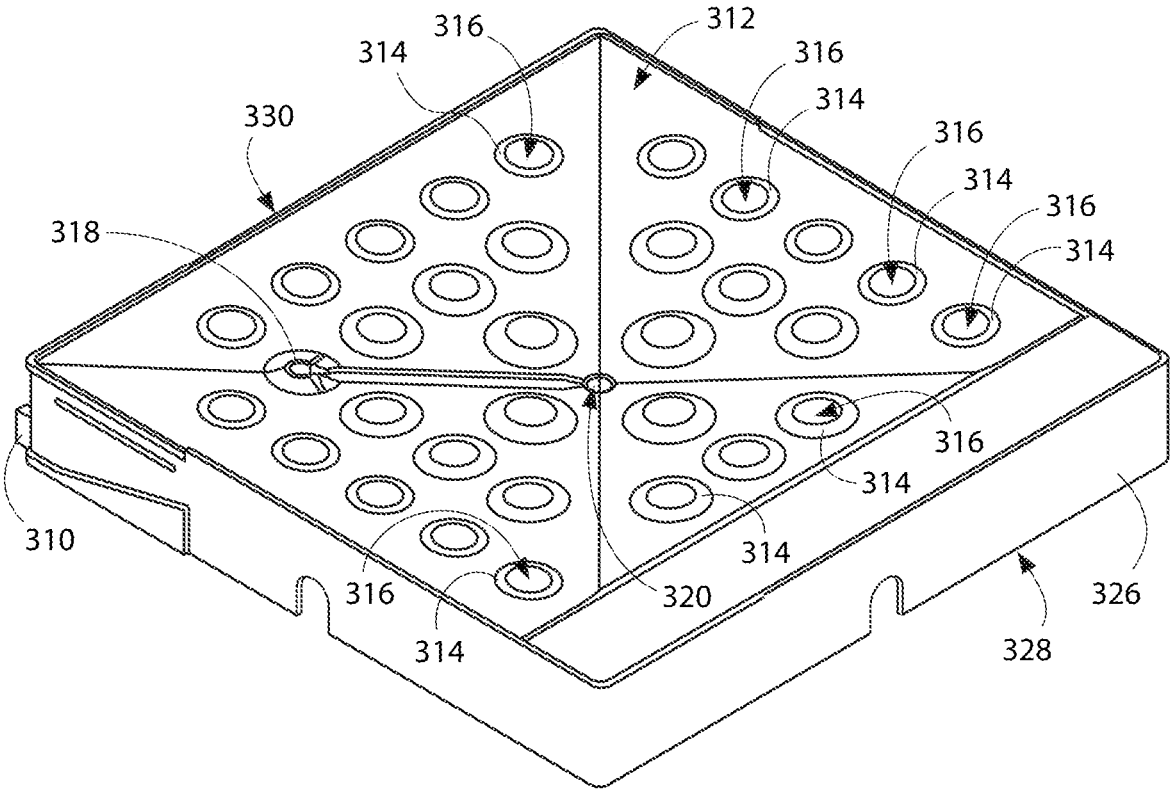
FIG. 4 provides a top perspective view of a drain pan according to one or more exemplary embodiments of the present disclosure which may be incorporated with the air conditioning appliance of FIG. 1.

Turning now to FIG. 4, the drain pan 300 is shown in isolation (e.g., without the housing 114 or plenum 200) to more clearly illustrate portions of the drain pan 300 according to one or more exemplary embodiments. As may be seen in FIG. 4, in some embodiments, the drain pan 300 includes an upper surface 312. The upper surface 312 may be positioned above the floor 151 (FIG. 3) when the drain pan 300 is in an installed position. In particular, the upper surface 312 may be the farthest portion or surface of the drain pan 300 from the floor 151 when in the installed position. As illustrated for example in FIG. 3, the upper surface 312 of the drain pan 300 may be in contact with the housing 114, with the housing 114 resting on the upper surface 312 of the drain pan 300. When so arranged, the drain pan 300 thereby defines a platform which structurally supports the housing 114, with the drain pan platform 300 either directly on the floor 151 (not shown) or elevated above the floor 151 on one or more legs 307, 308, as illustrated for example in FIG. 3.

Referring specifically to FIG. 4, in some embodiments, the upper surface 312 of the drain pan 300 may include one or more protrusions, e.g., bumps, 314 formed thereon. The protrusions 314 may be proud of the upper surface 312, e.g., the protrusions 314 may extend upward along the vertical direction V (FIG. 1) relative to the remainder of the upper surface 312. Thus, the entire upper surface 312 of the drain pan 300 may not be in contact with the housing 114, e.g., in embodiments where the protrusions 314 are provided on the upper surface, only the protrusions 314 on the upper surface 312 may be in contact with the housing 114.

Further, in some embodiments, the protrusions 314 may be generally rounded, e.g., each protrusion 314 may include a dome or top surface 316 which has the shape of a portion of a sphere, such as a hemisphere or less than half of a sphere, or more than half of a sphere but less than a complete sphere. In additional embodiments, the protrusions 314 may include a partial spherical (e.g., hemispherical, etc.) top surface 316 of the or each protrusion 314, while the remainder (outer portion) of the or each protrusion 314 provides a transition radius or fillet between the convex curvature of the top surface 316 and the generally linear portions of the upper surface 312 adjacent to the or each protrusion 314. In additional embodiments, the protrusions 314 may define any suitable cross-sectional shape (e.g., in a plane generally parallel to the remainder of the upper surface 312 of the drain pan 300) in addition to or instead of circular, e.g., elongated, ellipsoid, angular, or other similar shapes including combinations thereof, e.g., in embodiments with multiple protrusions 314, one or more protrusions may be partially spherical while one or more other protrusions 314 may have a different shape. Thus, in such embodiments, the protrusion 314, or protrusions 314 collectively, and in particular the top surface(s) 316 thereof, may define or provide a contact surface upon which the housing 114 rests when assembled.

By breaking up the contact surface between the drain pan 300 and the housing 114, e.g., by providing contact over less than all of the surface area of the upper surface 312, the protrusions 314 may define a reduced total contact area between the housing 114 and the drain pan 300, e.g., the total contact area between the housing 114 and the drain pan 300 may be the cumulative area of the portion of each top surface 316 in contact with the housing 114 and/or base 136, which is less than the total surface area of the upper surface 312 of the drain pan 300. Such reduced total contact area between the housing 114 and the drain pan 300 may result in reduced friction between the housing 114 and the drain pan 300, such as during installation. For example, the drain pan 300 may be connected to the plenum 200 after the plenum 200 is installed within the wall 150 and the housing 114 may then be placed on the platform defined by the drain pan 200 and slid into place and/or the alignment of the housing 114 with the plenum 200 may be adjusted by sliding the housing 114 on the upper surface 312 of the drain pan 300. In such examples, the top surfaces 316 of the protrusions 314 may make such sliding or other movement of the housing 114 easier due to the reduced contact area and reduced friction between the housing 114 and the drain pan 300.

Additionally, where the protrusions 314 are proud of the remainder, e.g., adjacent portions, of the upper surface 312, a drain space may thereby be provided. For example, when the housing 114 is supported atop the protrusions 314, the bottom of the housing is thus spaced apart from the remainder of the upper surface 312, e.g., above the remainder of the upper surface 312 along the vertical direction V. Therefore, liquids such as water, e.g., condensate, from the housing 114 may flow freely down the slope of the drain pan 300 into the drain 318 (described in more detail below) while maintaining the support of the housing 114.

Figure 5:
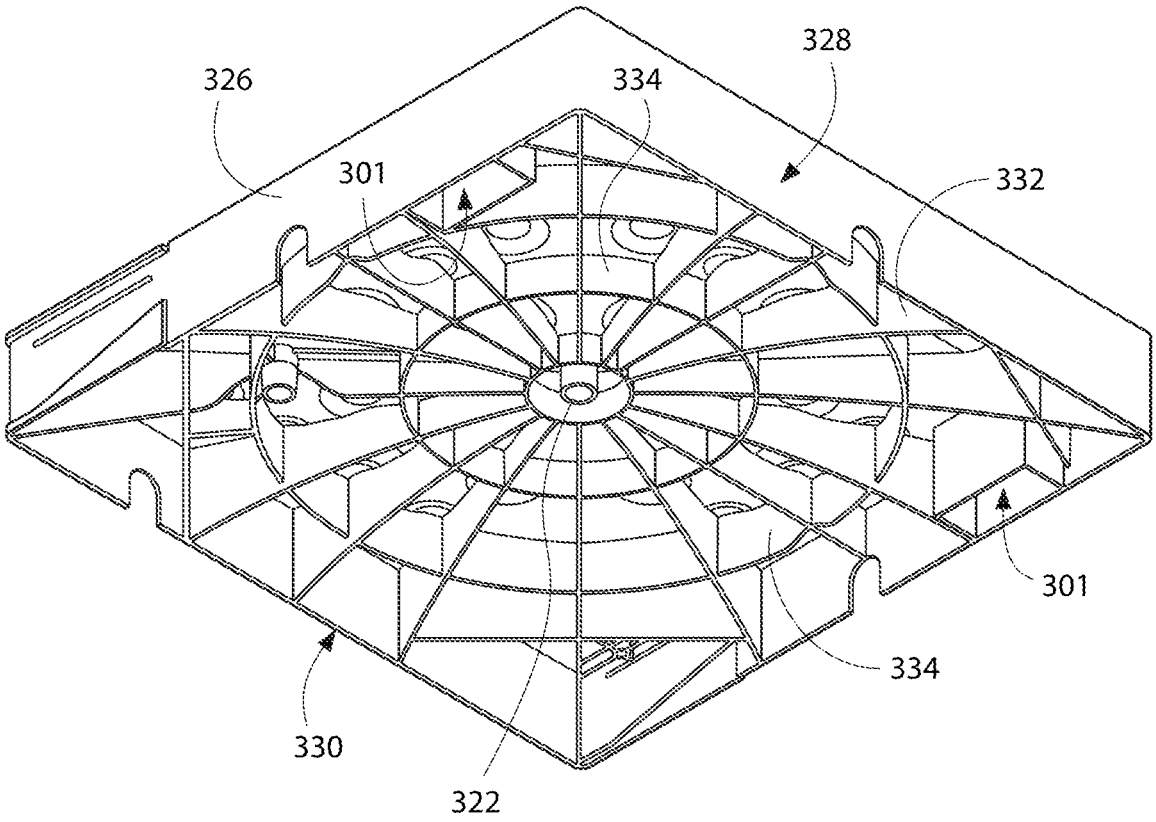
FIG. 5 provides a bottom perspective view of the drain pan of FIG. 4.
Figure 6:
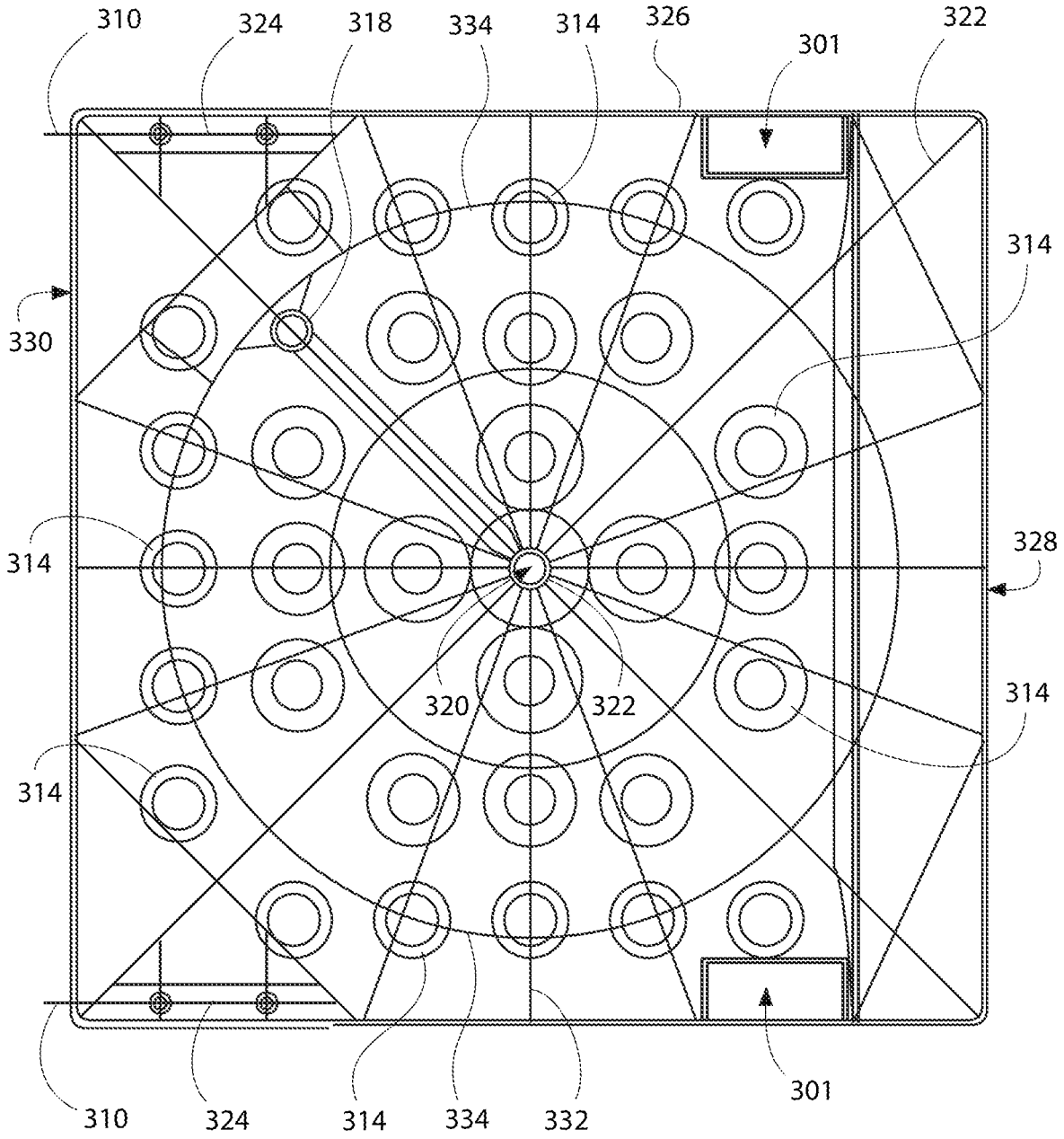
FIG. 6 provides a bottom view of the drain pan of FIG. 4.

In some embodiments, e.g., as illustrated in FIGS. 4 and 6, the drain pan 300 may include an overflow drain 318 defined in the upper surface 312 of the drain pan 300. For example, the base 136 of the housing 114 may collect condensate during operation of the air conditioner 100. In some cases, such as when the housing 114 is out of level, condensate may overflow from or otherwise spill out of the base 136 of the housing 114. In such cases, the spilled or overflowed condensate from the base 136 may be collected and channeled by the overflow drain 318 in the upper surface 312 of the drain pan 300. Additionally, in some embodiments, the drain pan 300 may also include a primary drain aperture 320 in the upper surface 312 of the drain pan 300. As may be seen in FIG. 5, the primary drain aperture 320 may form an opening or inlet into a cylindrical drain spout 322. In some embodiments, the upper surface 312 of the drain pan 300 may be concave and may slope towards the primary drain aperture 320. For example, the primary drain aperture 320 may be defined at a low point of the upper surface 312, such that any moisture, e.g., condensate from the housing 114, which reaches the upper surface 312 of the drain pan 300 will be directed to the primary drain aperture 320. In some embodiments, the primary drain aperture 320 may be located at or proximate to a center of the upper surface 312 of the drain pan 300, e.g., as illustrated in FIG. 4. In other embodiments, the primary drain aperture 320 may be offset from or spaced apart from the center of the upper surface 312.

As mentioned above, the drain pan 300 may include at least one hook 310 for connecting to the plenum 200. In some embodiments, e.g., as illustrated in FIGS. 4 through 6, the drain pan 300 may extend from a front end 328 to a back end 330 opposite the front end 328. In such embodiments, the drain pan 300 may also include a bracket 324 (see, e.g., FIG. 6) positioned at the back end 330 of the drain pan 300. For example, the front end 328 of the drain pan 300 may be proximate to and/or aligned with the front opening 118 (FIG. 3), and the back end 330 of the drain pan 300 may correspond to a side of the drain pan 300 which is adjacent to the plenum 200 when in the installed position, e.g., spaced apart from the front end 328 along the transverse direction T, such as opposite the front end 328 along the transverse direction T. In such embodiments, the hook 310 may be formed on the bracket 324.

As best seen in FIGS. 4 and 5, the drain pan 300 may include a skirt 326. The skirt 326 may extend from the upper surface 312, such as downward along the vertical direction V from the upper surface 312 to or towards the floor 151 (FIG. 3). The skirt 326 may extend generally perpendicular to the upper surface 312. The skirt 326 may extend continuously around a perimeter of the drain pan 300, such as along each outermost edge of the upper surface 312.

As may be seen in FIGS. 5 and 6, the drain pan 300 may include one or more structural reinforcing members within an interior of the drain pan 300. For example, the interior of the drain pan 300 may be defined within an area enclosed by the skirt 326 and below the upper surface 312. Such structural reinforcing members may be or include one or more of a plurality of radial ribs 332, e.g., which may originate at the central drain spout 322 and extend to the skirt 326, and a plurality of concentric circumferentially oriented braces 334, e.g., which extend around the central drain spout 322.

In some embodiments, the drain pan 300 may be made of a one-piece construction. For example, the sockets 301, upper surface 312, skirt 326, ribs 332, and braces 334 may all be integrally formed of a single seamless one-piece unitary construction. In some embodiments, such components (or subcombinations thereof) of the drain pan 300 may be integrally formed by casting, injection molding, or additive manufacturing, among numerous other suitable example methods of integrally forming.

Figure 7:
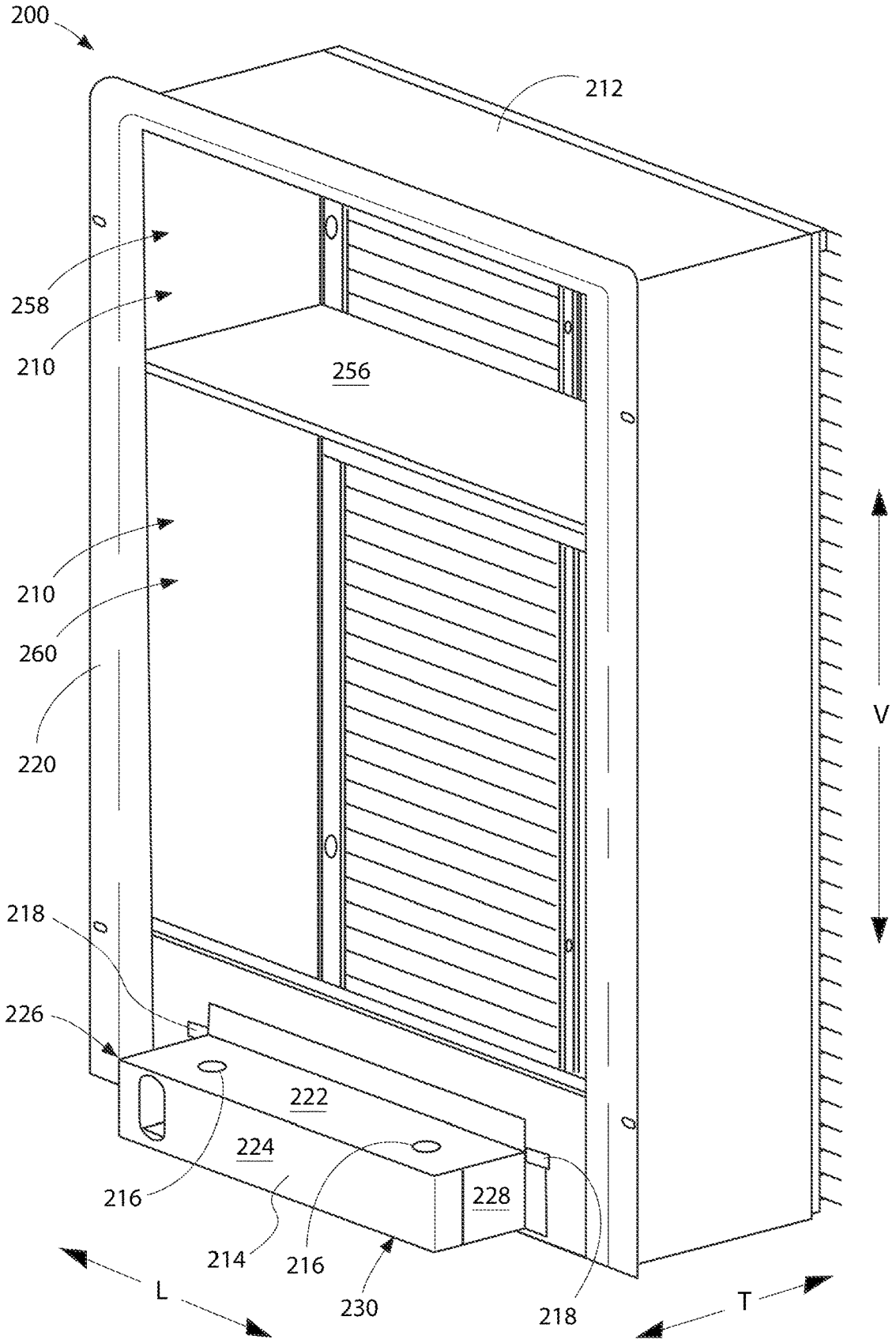
FIG. 7 provides a perspective view of a plenum according to one or more exemplary embodiments of the present disclosure which may be incorporated with the air conditioning appliance of FIG. 1.
Figure 8:
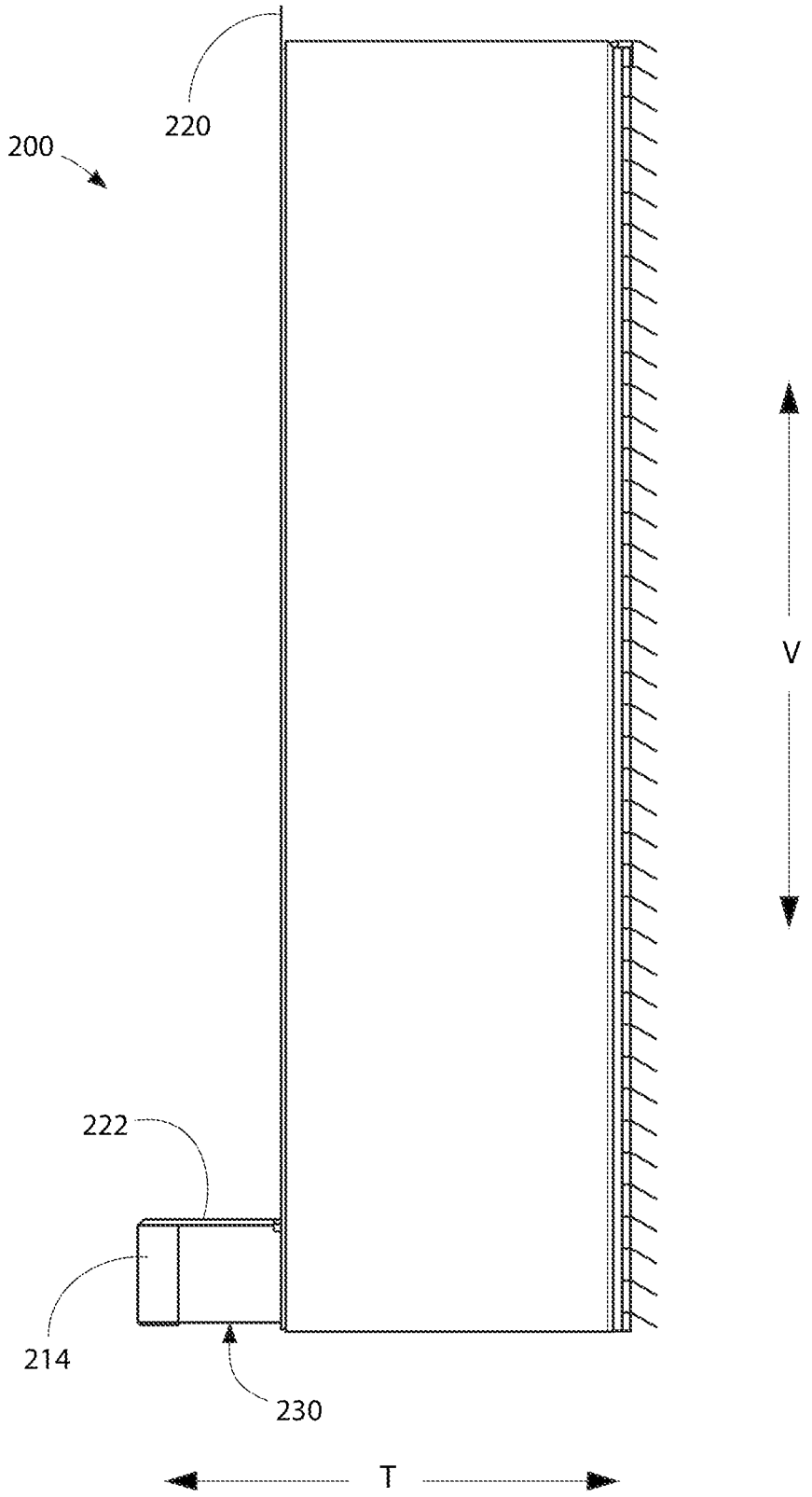
FIG. 8 provides a side section view of the plenum of FIG. 7.
Figure 9:
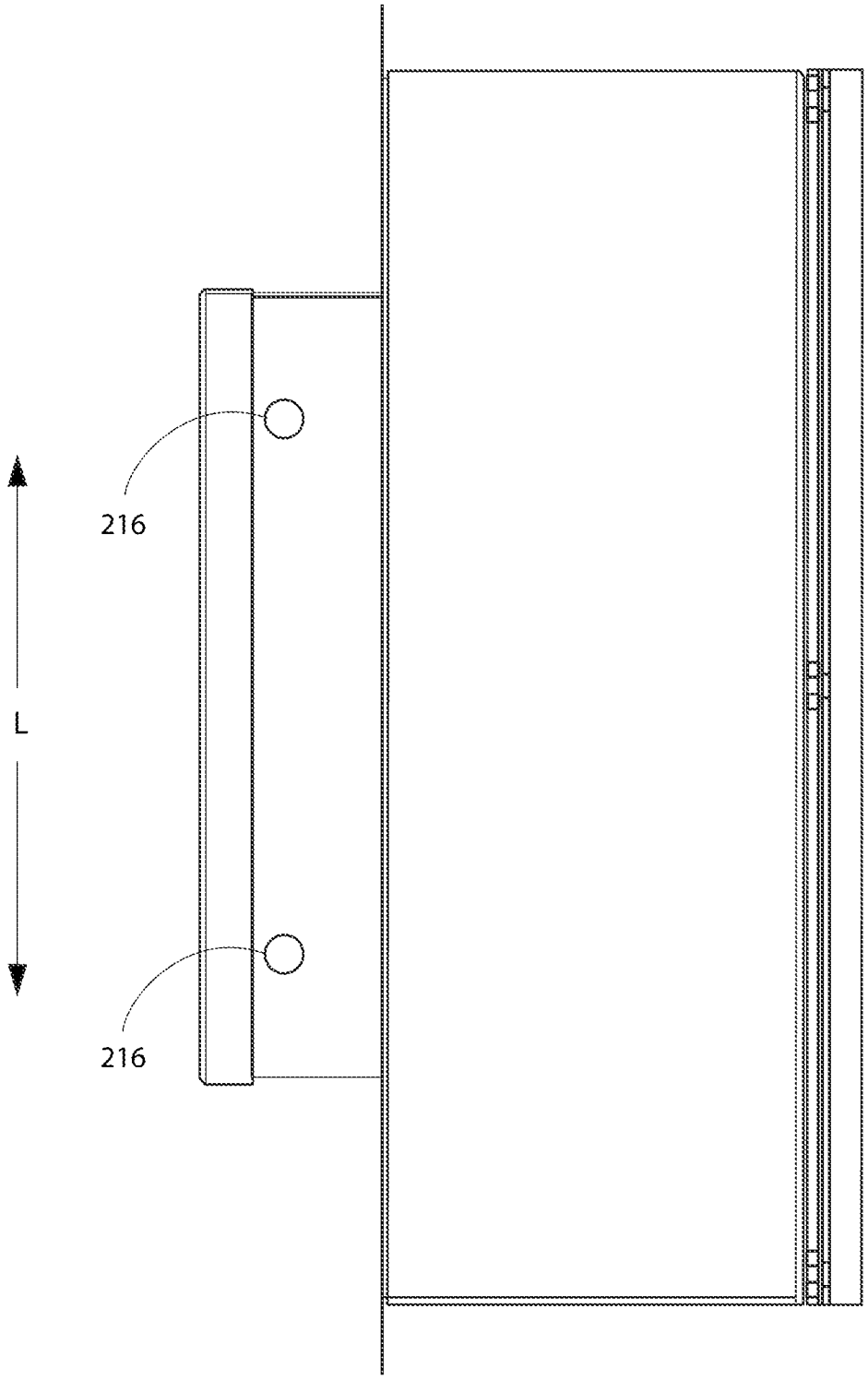
FIG. 9 provides a bottom view of the plenum of FIG. 7.

Turning now to FIG. 7, in some embodiments, the plenum 200 may include a box-shaped ledge or shelf 214 that projects along the axial direction X from an interior side of the plenum 200. In some embodiments, the shelf 214 may support the drain pan 300, e.g., at the back end 330 thereof. The shelf 214 may be provided instead of or in addition to the hook 310 and slot 262 (FIG. 2). As may be seen in FIGS. 8 and 9, the shelf 214 may be hollow. For example, in some embodiments, the shelf 214 may include a top panel 222, a front panel 224, a first side panel 226, and a second side panel 228, with an open bottom 230. Also as generally seen in FIGS. 7 through 9, the shelf 214 may include one or more holes 216 in the top panel 222 and the plenum 200 may include one or more slots 218 formed proximate to, e.g., adjacent to and/or adjoining, the shelf 214.

Figure 10:
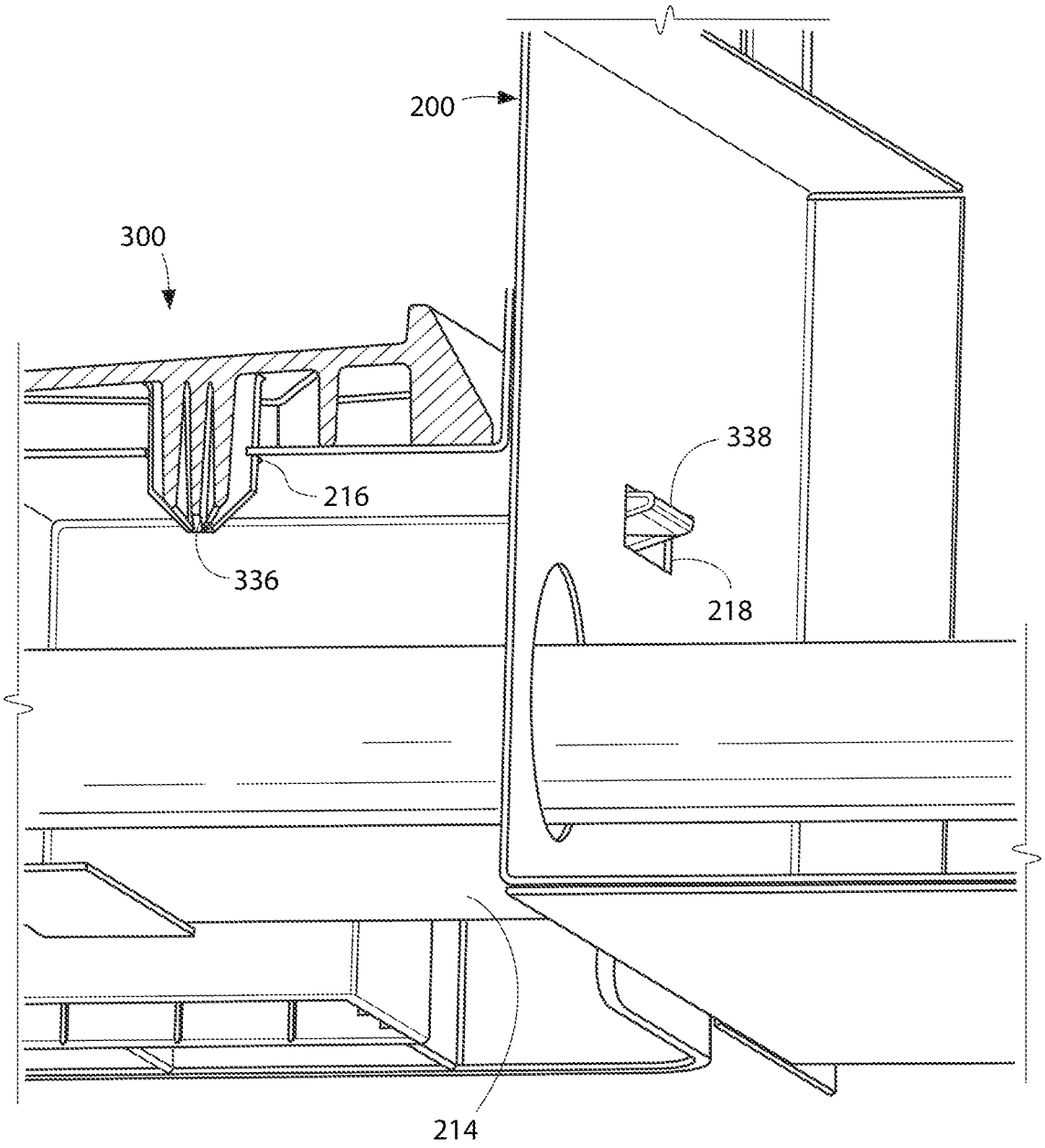
FIG. 10 provides an enlarged view of a portion of the exemplary air conditioner unit of FIG. 1 according to one or more additional exemplary embodiments of the present disclosure.

As illustrated in FIG. 10, in some embodiments, the drain pan 300 may interlock with the plenum 200, e.g., via one or both of the holes 216 and the slots 218. For example, as may be seen in FIG. 10, the drain pan 300 may include one or more pins 336 that extend, e.g., vertically, such as downward, and which are configured to engage the holes 216 in the top panel 222 of the shelf 214. The pins 336 may correspond in number, shape, and size with the holes 216, such as two round pins 336 and two round holes 216, as in the illustrated exemplary embodiments. Additionally, the drain pan 300 may, in some embodiments, also include one or more tabs 338 which extend horizontally, e.g., backward (away from the front end 328), such as along the transverse direction T, and which are configured to engage the slots 218 in the plenum 200. For example, the tabs 338 configured to engage with the slots 218 may include the tabs 338 corresponding in number, shape, and size with the slots 218.

Figure 11:
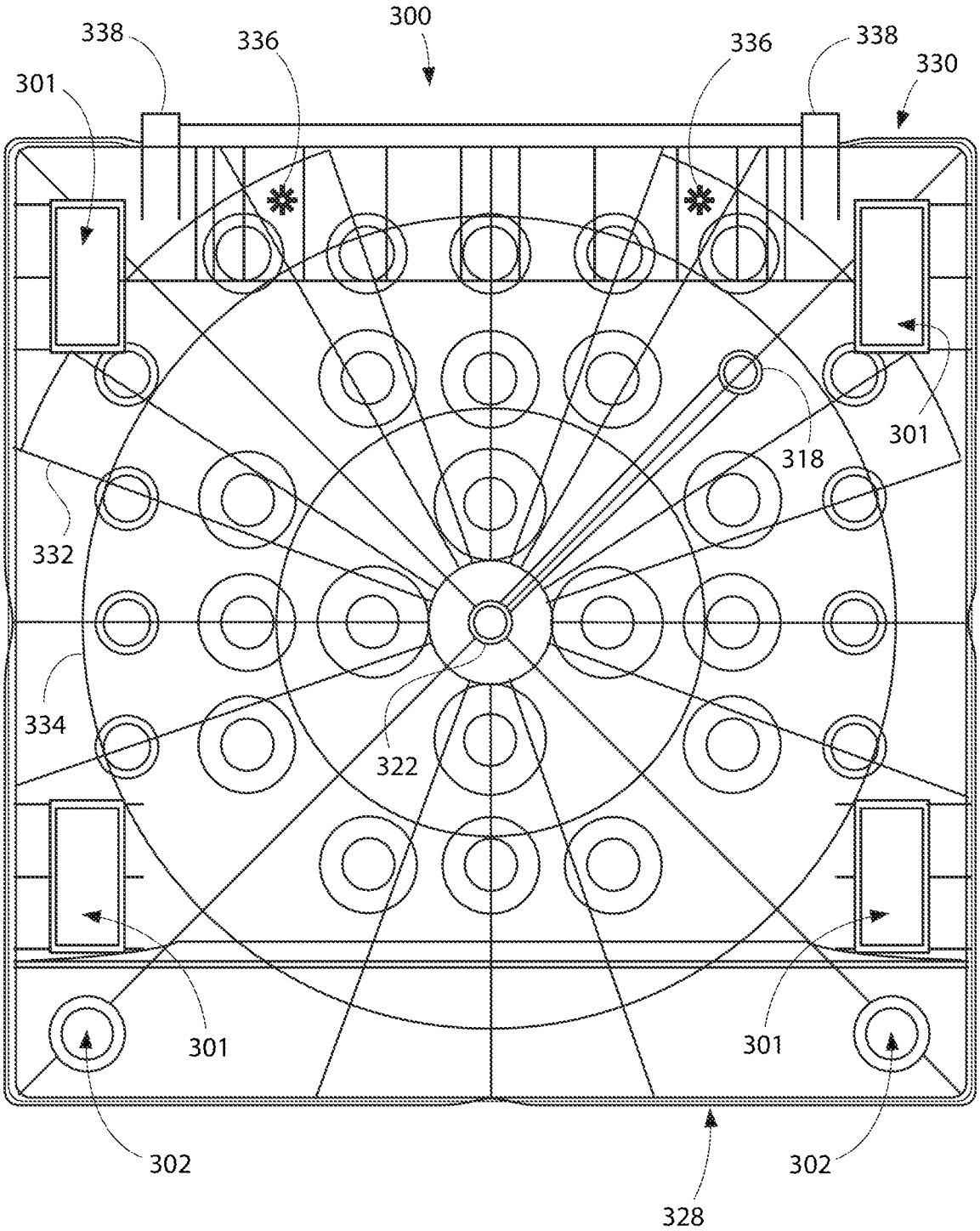
FIG. 11 provides a bottom view of a drain pan according to one or more additional exemplary embodiments of the present disclosure which may be incorporated with the air conditioning appliance of FIG. 1.

FIG. 11 provides a bottom view of the drain pan 300 according to one or more exemplary embodiments. As mentioned above, in some embodiments, the drain pan 300 may include multiple laterally-spaced pairs of sockets 301 and/or 302. For example, in the exemplary embodiment illustrated in FIG. 11, the drain pan 300 includes a front pair of sockets, e.g., proximate the front end 328 of the drain pan 300, and a back pair of sockets, e.g., proximate the back end 330 of the drain pan 300. In the example embodiment illustrated in FIG. 11, each pair of sockets is a pair of rectangular first sockets 301 which may be configured to receive rectangular legs, such as two-by-fours or other suitable legs, as described above.

Figure 12:
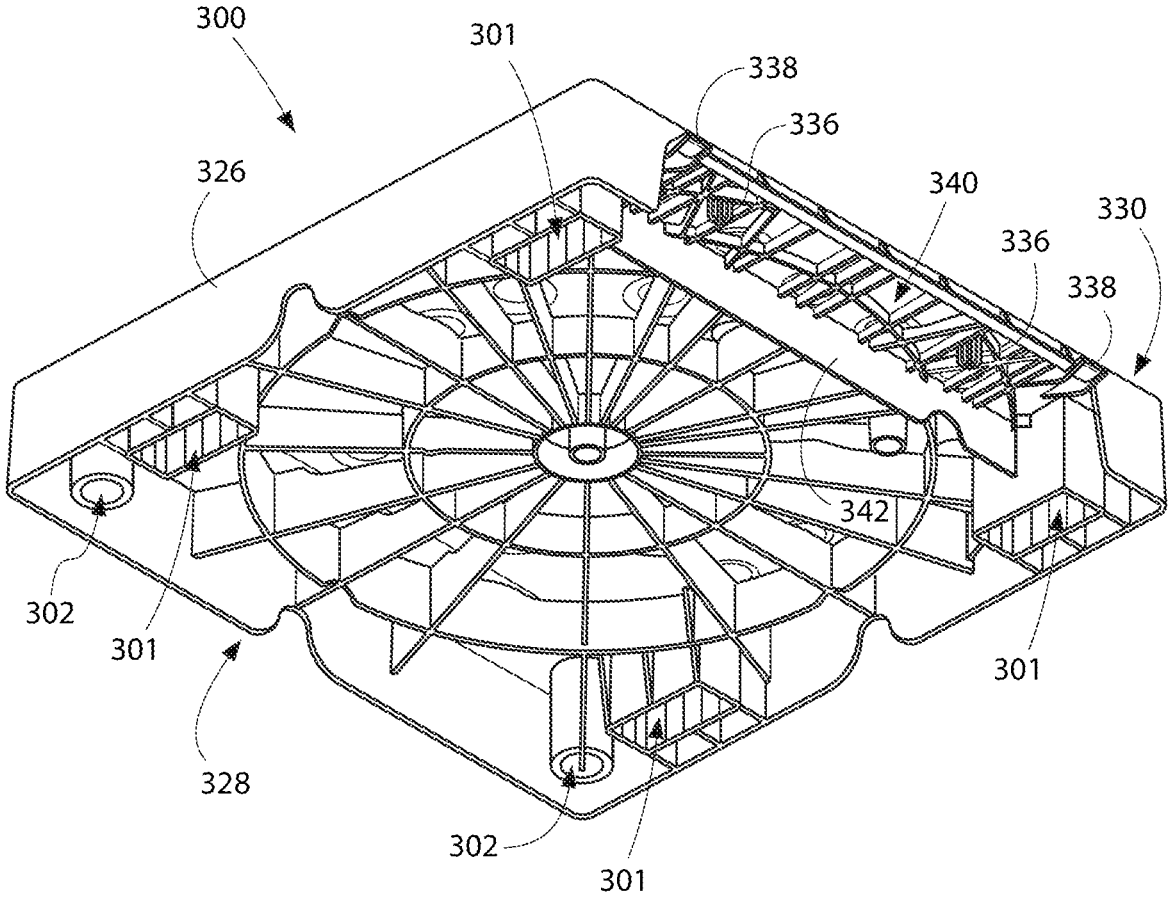
FIG. 12 provides a bottom perspective view of the drain pan of FIG. 11.

In some embodiments, e.g., as illustrated in FIG. 12, the drain pan 300 may include an opening 340 in the skirt 326 of the drain pan 300. When assembled, the shelf 214 of the plenum 200 may fit within the opening 340 of the drain pan 300. The drain pan 300 may also include a wall 342 inboard of the opening 340, such as offset from the skirt 326 along the transverse direction. The wall 342 may extend generally along the lateral direction L. The wall 342 of the drain pan 300 may be generally parallel to the front panel 224 of the shelf 214.

Figure 13:
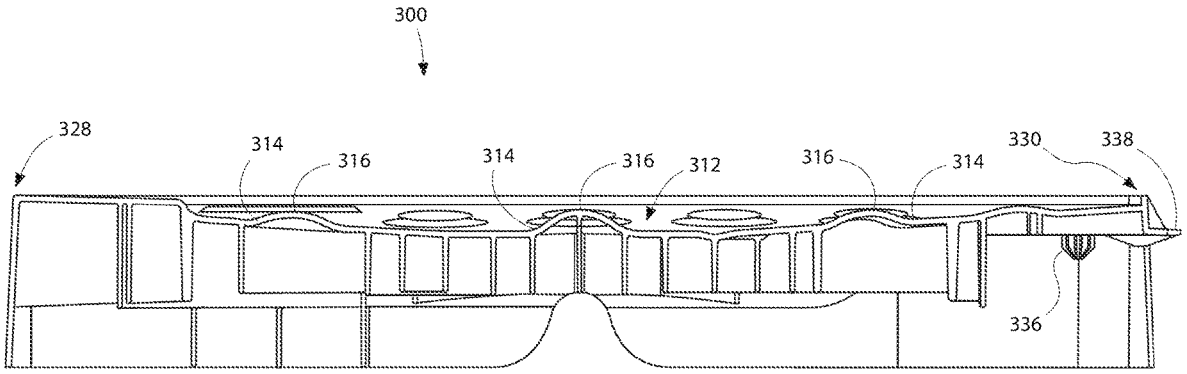
FIG. 13 provides a section view of the drain pan of FIG. 11.
Figure 14:
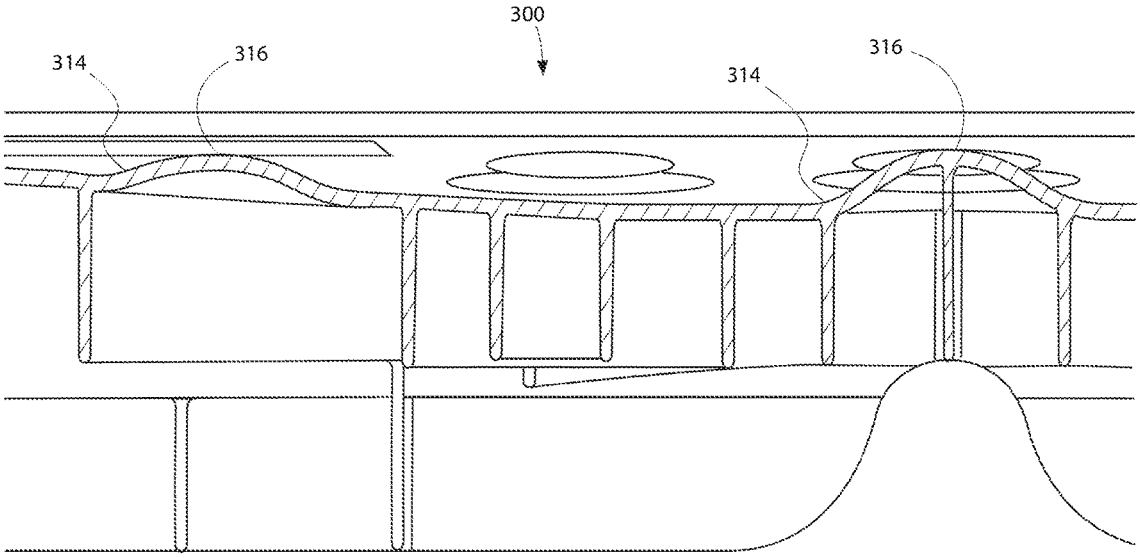
FIG. 14 provides an enlarged view of a portion of FIG. 13.

FIG. 13 provides a side section view of the drain pan 300 according to one or more embodiments of the present disclosure, and FIG. 14 provides an enlarged view of a portion of FIG. 13. As may be seen in FIGS. 13 and 14, the protrusions 314 are proud of, e.g., extend upward along the vertical direction V away from, the remainder of the upper surface 312. Also as may be seen in FIGS. 13 and 14, the height of the protrusions 314 above the remainder of the upper surface 312 may vary across the drain pan 300. For example, where the upper surface 312 generally slopes towards the primary drain 320, as described above, one or more protrusions 314 which are downhill along that slope compared to one or more other protrusions 314 may be taller than the one or more other protrusions 314 with respect to their height above the adjacent or adjoining portion of the remainder of the upper surface 312 to each respective protrusion 314. In particular, the height of the protrusions 314 relative to each respective adjoining portion of the remainder of the upper surface 312 may vary such that the uppermost points on each top surface 316 on which the housing 114 will rest are generally coplanar within a plane perpendicular to the vertical direction V. For example, the uppermost point of each top surface 316 may be generally aligned along the vertical direction V with the uppermost point of every other top surface 316, e.g., where the vertical direction V, the lateral direction L, and the transverse direction T define a coordinate system, the uppermost point of each top surface 316 would have generally the same vertical coordinate. Thus, the contact surface provided by the top surfaces 316 of the protrusions 314 may be generally level and/or generally parallel to the floor 151.

In at least some embodiments, the interacting features on the various components described herein may provide an indexing feature which advantageously provides a confirmation of proper alignment and complete installation of, e.g., the air conditioner unit 100 on the drain pan 300 and abutting the plenum 200. For example, the interaction of the base 136 of the housing 114 with the drain pan 300, e.g., the top surface(s) 316 of the protrusion(s) 314 thereon, may create a perceptible user feedback, e.g., a tactile and/or audible response, when the air conditioner unit 100 settles into the proper location in the installed condition.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An air conditioner unit defining a mutually-perpendicular vertical direction, lateral direction, and transverse direction, the air conditioner unit comprising:

a housing defining an outdoor portion and an indoor portion;

an outdoor heat exchanger assembly disposed in the outdoor portion and comprising an outdoor heat exchanger and an outdoor fan;

an indoor heat exchanger assembly disposed in the indoor portion and comprising an indoor heat exchanger and an indoor fan;

a compressor in fluid communication with the outdoor heat exchanger and the indoor heat exchanger to circulate a refrigerant between the outdoor heat exchanger and the indoor heat exchanger;

a drain pan positioned below the housing along the vertical direction, the drain pan comprising an upper surface in contact with the housing of the air conditioner unit and a socket configured to receive a leg; and a plenum attached to the housing and to the drain pan, the plenum receivable within a wall channel defined by a structure wall along an axial direction, wherein the housing of the air conditioner unit rests on the upper surface of the drain pan, whereby the drain pan defines a platform which structurally supports the housing of the air conditioner unit, wherein the drain pan comprises a hook configured to engage a slot in a mating surface of the plenum and thereby attach the drain pan to the plenum.

2. The air conditioner unit of claim 1, further comprising a plurality of protrusions defined on the upper surface of the drain pan, wherein the plurality of protrusions on the upper surface of the drain pan define a reduced total contact area between the housing and the drain pan and thereby reduce friction between the housing and the drain pan during installation, wherein the reduced total contact area is less than a total surface area of the upper surface of the drain pan.

3. The air conditioner unit of claim 1, wherein the plenum comprises a shelf configured to engage with the drain pan, the shelf comprising a hole and the drain pan comprising a pin, the hole of the shelf configured to receive the pin of the drain pan.

4. The air conditioner unit of claim 1, further comprising a primary drain aperture in the upper surface of the drain pan, wherein the upper surface of the drain pan slopes towards the primary drain aperture and wherein a drain space is provided below the housing of the air conditioner unit.

5. The air conditioner unit of claim 1, wherein the socket and the hook are positioned opposite one another on the drain pan along the transverse direction.

6. The air conditioner unit of claim 1, wherein the drain pan comprises a bracket positioned at a back end of the drain pan, and wherein the hook is formed on the bracket.

7. The air conditioner unit of claim 1, wherein the socket has a multi-sided rectangular cross-section and is configured to receive a dimensional lumber leg.

8. The air conditioner unit of claim 1, wherein the socket is cylindrical and is configured to receive a tubular leg.

9. The air conditioner unit of claim 1, wherein the drain pan is integrally formed of a unitary one-piece construction.

10. An air conditioning appliance, the air conditioning appliance comprising:

a housing defining an outdoor portion and an indoor portion;

an outdoor heat exchanger assembly disposed in the outdoor portion and comprising an outdoor heat exchanger and an outdoor fan;

an indoor heat exchanger assembly disposed in the indoor portion and comprising an indoor heat exchanger and an indoor fan;

a compressor in fluid communication with the outdoor heat exchanger and the indoor heat exchanger to circulate a refrigerant between the outdoor heat exchanger and the indoor heat exchanger;

a drain pan positioned below the housing, the drain pan comprising an upper surface in contact with the housing of the air conditioning appliance and a socket configured to receive a leg; and a plenum attached to the housing and to the drain pan, the plenum receivable within a wall channel defined by a structure wall along an axial direction, wherein the housing of the air conditioning appliance rests on the upper surface of the drain pan, whereby the drain pan defines a platform which structurally supports the housing of the air conditioning appliance, wherein the plenum comprises a shelf configured to engage with the drain pan, the shelf comprising a hole and the drain pan comprising a pin, the hole of the shelf configured to receive the pin of the drain pan.

11. The air conditioning appliance of claim 10, further comprising a plurality of protrusions defined on the upper surface of the drain pan, wherein the plurality of protrusions on the upper surface of the drain pan define a reduced total contact area between the housing and the drain pan and thereby reduce friction between the housing and the drain pan during installation, wherein the reduced total contact area is less than a total surface area of the upper surface of the drain pan.

12. The air conditioning appliance of claim 10, further comprising a primary drain aperture in the upper surface of the drain pan, wherein the upper surface of the drain pan slopes towards the primary drain aperture and wherein a drain space is provided below the housing of the air conditioning appliance.

13. The air conditioning appliance of claim 10, wherein the drain pan comprises a hook configured to engage a slot in a mating surface of the plenum and thereby attach the drain pan to the plenum.

14. The air conditioning appliance of claim 13, wherein the socket and the hook are positioned opposite one another on the drain pan along a transverse direction.

15. The air conditioning appliance of claim 13, wherein the drain pan comprises a bracket positioned at a back end of the drain pan, and wherein the hook is formed on the bracket.

16. The air conditioning appliance of claim 10, wherein the socket has a rectangular multi-sided cross-section and is configured to receive a dimensional lumber leg.

17. The air conditioning appliance of claim 10, wherein the socket is cylindrical and is configured to receive a tubular leg.

18. The air conditioning appliance of claim 10, wherein the drain pan is integrally formed of a unitary one-piece construction.

* * * * *